United States Patent [19]

King

[11] Patent Number: 5,050,847

[45] Date of Patent: Sep. 24, 1991

[54] STAGED VALVE MULTI-HOLE INJECTION BLOCK AND METHOD

[75] Inventor: Patrick D. King, Rantoul, Ill.

[73] Assignee: Flo-Con Systems, Inc., Champaign, Ill.

[21] Appl. No.: 515,413

[22] Filed: Apr. 27, 1990

Related U.S. Application Data

[63] Continuation-in-part of Ser. No. 53,080, May 22, 1987, Pat. No. 4,771,992, which is a continuation-in-part of Ser. No. 14,999, Feb. 17, 1987, Pat. No. 4,799,649, which is a continuation-in-part of Ser. No. 885,873, Jul. 15, 1986, Pat. No. 4,824,079.

[51] Int. Cl.[5] ..... C21C 5/48

[52] U.S. Cl. ..... 266/44; 266/220; 266/268

[58] Field of Search ..... 266/220, 218, 265, 268, 266/44

[56] References Cited

U.S. PATENT DOCUMENTS 4,771,992 9/1988 King ..... 266/268
4,802,655 2/1989 Bates ..... 266/268
4,815,715 3/1989 Ganson et al. ..... 266/268
4,919,397 4/1990 King ..... 266/265

*Primary Examiner*—S. Kastler
*Attorney, Agent, or Firm*—Jack E. Dominik

[57] ABSTRACT

An injection block of an injection valve intended for bottom injection but optionally operable on the side of a teeming vessel for side injection is disclosed. The invention is directed specifically to a multi-passageway multi-orifice injection block in which the injection passages may be parallel, radially disposed around a frusto-conical locus, or angled in a tangential fashion within the injection block. The thrust of the invention, however, is to stage the permeable elements in progressively more buried relationship to the hot face of the injection block sequenced in the order in which the particular passageways which are plugged by the porous plug are programmed for use. In this manner, progressive erosion of the wet or hot face of the injection block will progressively expose the upper portion of the permeable plug in accordance with the timed usage intended for the same.

17 Claims, 4 Drawing Sheets

STAGED VALVE MULTI-HOLE INJECTION BLOCK AND METHOD

CROSS-REFERENCE TO RELATED APPLICATIONS

The present application is a continuation-in-part of application Ser. No. 053,080 filed May 22, 1987 and entitled "Multi-Hole Injection Valve and Method" now issued into U.S. Pat. No. 4,771,992 dated Sept. 20, 1988; which in turn is a continuation-in-part of application Ser. No. 014,999 filed Feb. 17, 1987 and entitled "Injection Valve" now issued into U.S. Pat. No. 4,799,649 dated Jan. 24, 1989; which application is a continuation-in-part of Ser. No. 885,873 filed July 15, 1986 and entitled "Injection Valve Components and Method" now issued into U.S. Pat. No. 4,824,079 dated Apr. 25, 1989; copending application Ser. No. 179,986 filed Apr. 22, 1988; and recently filed application Ser. No. 461,222 filed Jan. 5, 1990.

FIELD OF THE INVENTION

The present invention relates to the injection block, and more particularly an injection block having a plurality of passageways which are staged to be activated in accordance with the erosion of the wet face of the block.

SUMMARY OF THE PRIOR ART

The prior art is exemplified in the above-mentioned Bates U.S. Pat. No. 4,575,393 and its own prior art. Injection valves such as the Bates valve are normally side mounted on the vessel which is utilized for teeming metal. The metal is normally teemed from the bottom. The purpose of the injection valve is to accomplish metallurgical functions in a ladle separate and apart from the active and somewhat corrosive environment of a furnace. Degasifiers, dephosphorizers, as well as additives such as nickel, molybdenum, and chromium can be inserted through injection valves.

Applicant's predecessor valves have all been primarily designed for bottom injection although they have the capability of being side mounted. In any usage of injection valves it is important to inject in such a fashion so that the "bubble" which is formed as the additives are injected with high pressure gas will break up and the solids allowed to react throughout the entirety of the teeming vessel. With a side mounted valve, it is questionable as to whether there is total penetration to the bottom of the vessel without additional stirring beyond that imparted by the injection and the gas under pressure.

The predecessor valves have an injection block with a wet face which erodes as to each passageway at substantially the same rate. This means that where several injection passageways such as eight are employed, the last passageway may have its wet or hot face eroded prior to being activated, which could cause the molten steel in the vessel to destroy the permeable plug.

SUMMARY OF THE INVENTION

The present invention is directed primarily to the injection block of an injection valve intended for bottom injection but optionally operable on the side of a teeming vessel for side injection. The invention is directed specifically to a multi-passageway multi-orifice injection block in which the injection passages may be parallel, radially disposed around a frustoconical locus, or angled in a tangential fashion within the injection block. The thrust of the invention, however, is to stage the permeable elements in progressively more buried relationship to the hot face of the injection block sequenced in the order in which the particular passageways which are plugged by the porous plug are programmed for use. In this manner, progressive erosion of the wet or hot face of the injection block will progressively expose the upper portion of the permeable plug in accordance with the timed usage intended for the same.

In view of the foregoing it is a principal object of the present invention to provide an injection block for an injection valve in which multiple permeable refractory elements are positioned in the passageway to the end that they will be progressively exposed, and in the event of a break-out, progressively secured because the only place where molten metal may pass through is in the injection passageway actually being used.

A related object of the present invention is to provide these advantages without significant additional cost to the injection block.

A further object of the present invention is to provide the staged permeable refractory injection block which is interchangeable with pre-existing injection valves.

BRIEF DESCRIPTION OF THE DRAWINGS

Further objects and advantages of the present invention will become apparent as the following description proceeds, taken in conjunction with the accompanying drawings, in which.

DESCRIPTION OF A PREFERRED EMBODIMENT

In the description which proceeds as directed to FIGS. 1-5, the details of the environment of a typical injection valve in which the injection block of the present invention finds its utility is set forth in detail. Upon completion of the description of the subject matter in FIGS. 1-5 relating to the valve, the description will proceed directed to FIGS. 6-16 which illustrate the specifics and variables of the permeable plug block.

Figures 1, 2:
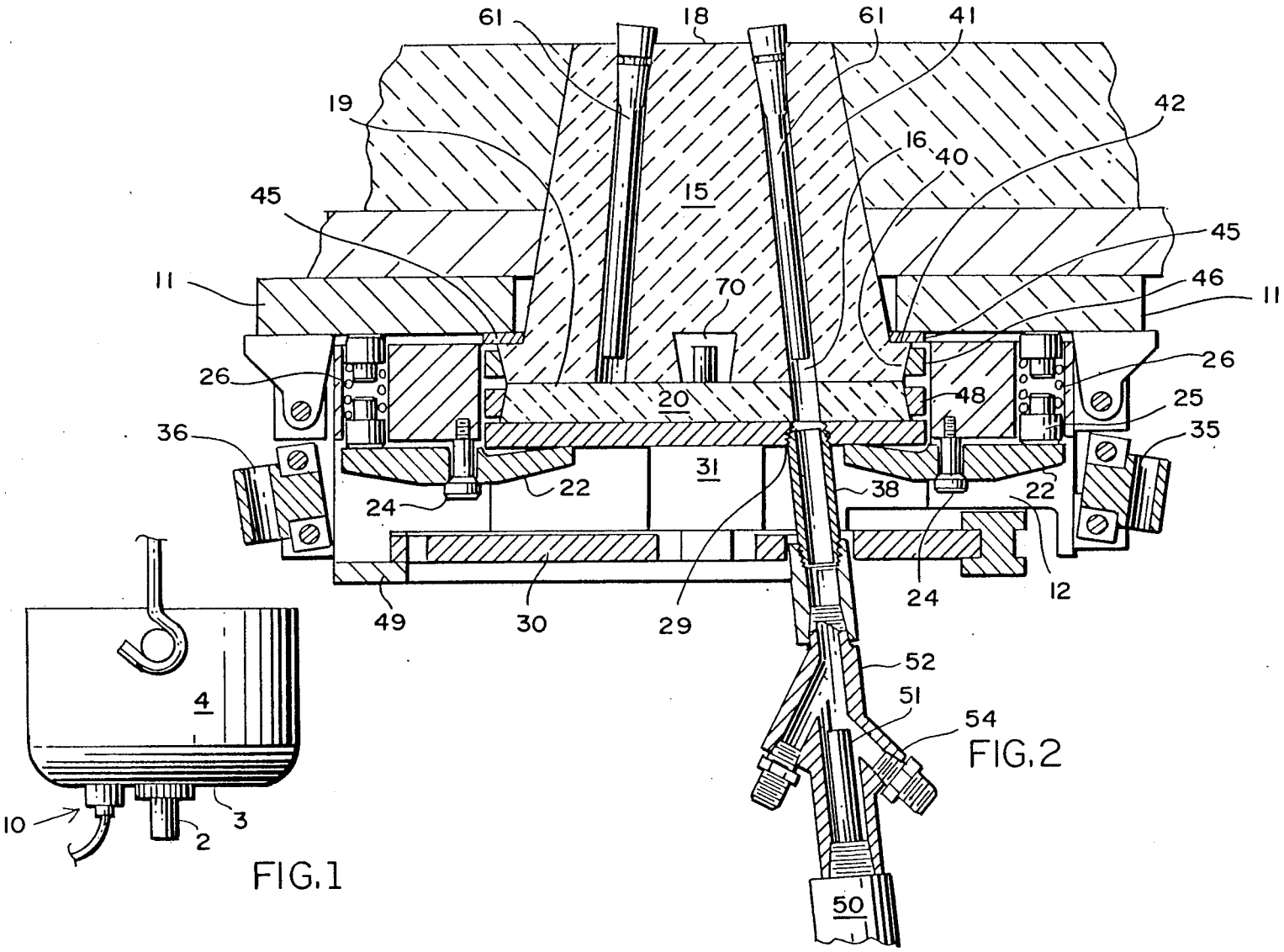
FIG. 1 is a front elevation, partially diagrammatic, showing a ladle which has a sliding gate valve for teeming as well as an injection valve illustrative of the present invention.
FIG. 2 is a transverse sectional view of the injection valve shown in FIG: 1 illustrating its various components.

For purposes of background, there is shown in FIG. 1 a ladle 1, having at its bottom portion a sliding gate teeming valve 2, which is secured to the ladle bottom 3. An injection valve illustrative of the present invention is indicated by the reference numeral 10 in FIG. 1 and though it is shown mounted to the ladle bottom 3 might alternatively be mounted to the ladle wall 4.

As shown in FIG. 2, the injection valve 10 is mounted to the vessel or ladle 1 by being secured to the ladle bottom 3 or wall 4, and penetrating the ladle refractory lining 5 through an opening 6. A mounting plate 11 is provided at the upper portion of the injection valve 10 to be bolted or otherwise secured to the ladle 1. A mainframe 12 is connected to and extends downward from the mounting plate 11 and holds the various elements of the injection valve 10.

Figure 3:
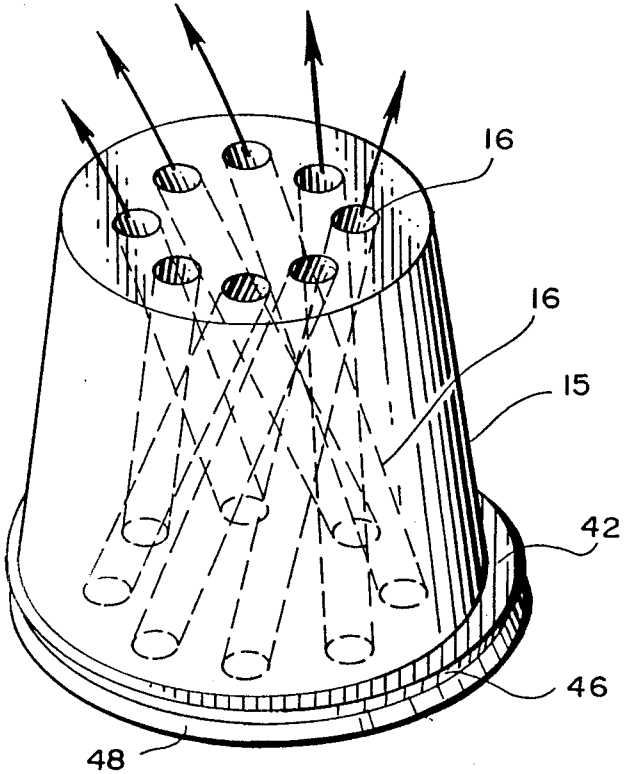
FIG. 3 is a perspective partially diagrammatic view of the subject injection block illustrating the angularity of the injection orifice passages, and diagrammatically the path of the injection once introduced into the vessel.

Central to the construction of the injection valve is the injection block 15 which is sealed to the ladle refractory lining 5 within the opening 6. The injection block 15 remains stationary during operation of the injection valve. To this end, the injection block may be elliptical or some shape other than circular in lateral cross-section to secure it against rotation inside the opening 6 and the opening 6 is complementary shaped to receive and lockingly engage the injection block 15. With in the injection block 15 are a plurality of injection orifice passages 16. The injection orifice passages 16 extend from the injection block outer face 19 through the injection block 15 to the injection block orifices 17 which are located in the wet face 18 of the injection block 15. As shown in FIG. 3, these injection orifices and their corresponding orifice passages are essentially oriented on a circle surrounding the axis of the injection block.

Also central to the injection valve is an injection slide plate 20 mounted on top of a slide plate carrier 21. The injection slide plate 20 is preferably elliptical or other non-circular shape in lateral cross-section along with the complemental means for mounting the same to the slide plate carrier 21 which will be described hereinafter.

In order to maintain the injection slide plate 20 in a pressure face-to-face sealing relationship with the outer face 19 of the injection block 15, a plurality of rocker arms 22 are provided to yieldably engage the slide pate carrier 21. The rocker arms are oriented radially around the slide plate carrier 21. Again as shown in FIG. 2, each rocker arm 22 is pivotally secured to the main frame 12 by a rocker arm bolt 24. One end of the rocker arm is engaged by spring pad 25 which, in turn, is urged by spring 26 to thereby pivot the rocker arm 22 and urge its opposite end to press against the slide plate carrier 21.

The injection slide plate 20 is provided with at least one orifice 28. A carrier pipe connector 38 that is secured to the slide plate carrier 21 in an orifice 29 extends through the drive plate 30 and is terminated with an inlet coupling 39. The slide plate carrier orifice 29 is designed to orientate the carrier pipe connector 38 and inlet coupling 39 beyond the injection slide plate 20 and in line wi&:h the orifice passages 16. Additional slide plate orifices 28, slide plate carrier orifices 29, inlet pipes 38 and inlet couplings 39 may be provided.

The rotating portion of the mechanism is driven by the drive plate 30, which acts through drive hub 31 having a hexagonal head 32 secured in the drive plate 30. The hub 31 connects directly into the slide plate carrier 21.

The mounting plate 11 of the injection valve 10 has a latch toggle 35, and an opposed hinge toggle 36 which acting together secure the main frame 12 to the mounting plate 11. By releasing the latch toggle and hinging the frame on the hinge toggle the injection valve 10 maybe opened up for servicing or replacing the injection block 15 and/or the slide plate 20, and other elements of the construction.

Turning again to FIG. 2, it will be seen in greater detail that the carrier pipe connector 38 which connects the slide plate carrier 21 and extends through the drive plate 30 includes an inlet coupling 39. As noted also in FIG. 2, the injection block 15 includes an injection block collar 40 which is preferably elliptical or other non-circular shaped in lateral cross-section, an injection block collar shoulder 42. The injection block collar shoulder 42 is engaged, as shown in FIG. 2, by a backing ring 45. A clamping ring 46 is provided for the injection block collar 40, and complementary shaped to the injection block collar 40. It thereby secures the injection block 15 in a non-rotating manner to the backing ring 45 which in turn engages the mounting plate 11. A similar clamp ring 48 is provided for the injection slide plate 20. It is similarly secured to the slide plate carrier 21. The drive plate retainer 49 as shown in FIG. 2 is attached to the main frame 11 and secures the drive plate 30.

When it is time to begin ladle metallurgy, the punch-out cylinder 50 is activated and its punch-out rod 51 extends through the multi-media connector body 52. The multi-media connector body 52 has a fluidized media port 54 and a wire port 55. The wire port 55 is upstream from the fluidized media port so that any wire injected is unrestricted and uninhibited by the interior elements contained in the multi-media connector body 52. Fluidized media may include any substances, gaseous, liquid, powdered or particulate which can be suspended in a fluid. Wire media can include solid wire of a particular metallurgy or cored wire containing liquid, powdered or particulate material.

The purpose of the punch-out rod 51 is to engage the orifice plug shaft portion 61 and force the orifice plug 60 together with the orifice plug shaft portion 9 of the injection block 15 and thus open the injection path between the multi-media connector body 52 and the interior of the vessel 1. Shown in prior application Ser. No. 053,080, now U.S. Pat. No. 4,771,992, are the specifics of the drive plate.

After injection has been completed, the vessel emptied, and the assembly is opened, the injection block 15 can be removed by engaging its puller 70 shown adjacent to the slide face of the injection block in FIG. 2. The puller 70 may be an insert shaped to mechanically engage the injection block molded into the injection block or may be a connector molded integral in the injection block 15. As illustrated it is an insert molded into the injection block having an internal thread for connection of a pulling device which is not shown. This provide a means to pull the injection block 15 out of the opening 6 in the ladle lining for replacement, or otherwise servicing.

Figure 4:
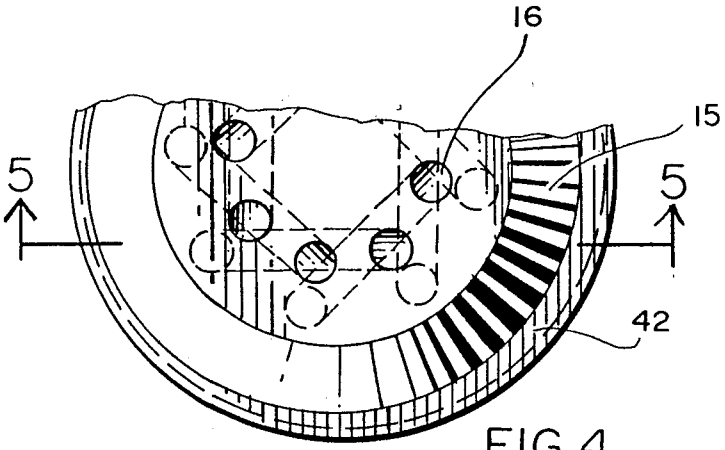
FIG. 4 is a top view of the injection block shown in FIG. 3, but partially broken to illustrate the relationship between various ones of the injection orifice passages.

The novelty in my copending patent application Ser. No. 461,222 filed Jan. 5, 1990 is best illustrated in FIGS. 2 and 3 where it will be seen that the axis of each of the injection orifice passages 16 may be angled radially toward the axis of the injection block 15 as shown in FIG. 2 and may be also angled tangentially relative to an element parallel to the axis of the injection block so as to circumvolve the axis of the injection block. The thrust of the invention in the copending application is best illustrated in FIGS. 2 and 3 where it will be seen that the axis of each of the injection orifice passages 16 may be angled radially toward the axis of the injection block 15 as shown in FIG. 2 and may be also angled tangentially relative to an element parallel to the axis of the injection block so as to circumvolve the axis of the injection block. The injection orifice passages may be angled radially only, tangentially only, or in a combination of radially and tangentially. It is possible to radially angle the axis of each of the injection orifice passages 16 and its associated injection apparatus to as much as 15° toward the axis of the injection block. The axis of the injection orifice passages 16 may be tangentially angled as much as 20° to 160° relative to an element parallel to the axis of the injection block. As shown in FIG. 4 with this degree of angling, the wet face orifice of each injection orifice passage will overlap the seal face entrance position of two adjacent injection orifice passages.

The angle to which the injection orifice passages are canted radially and tangentially is limited by the requirement of having sufficient material in the space between passages and between the passages and the frustoconical sidewall 41 of the injection block as well as between injection block orifices 17 in the wet face 18.

Figure 6:
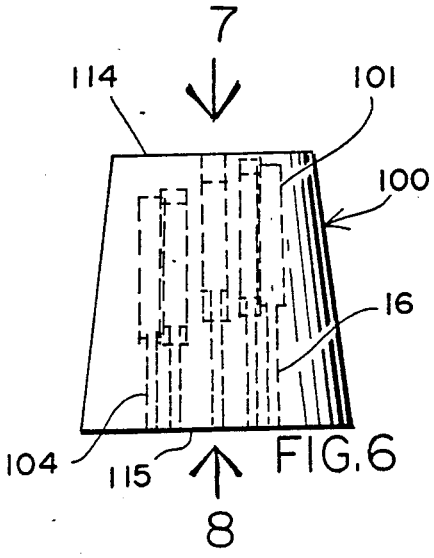
FIG. 6 is a front elevation of an illustrative injection block in which the passageways are parallel with the vertical axis of the frustoconical refractory block.
Figure 7:
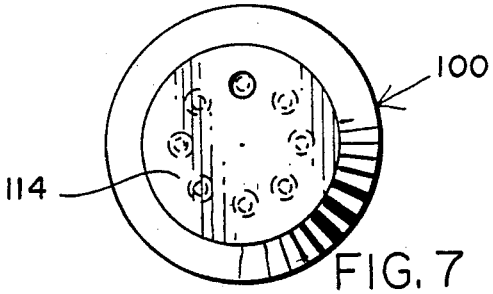
FIG. 7 is a top view of the block shown in FIG. 6.
Figure 8:
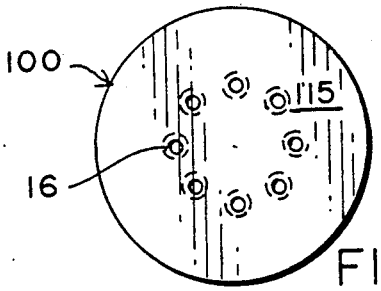
FIG. 8 is a bottom view of the block shown in FIG. 6.

Turning now to FIG. 6, it will be seen that the illustrative multiple element permeable refractory system of the present invention contemplates the injection block 100, embedded permeable elements 101, gas ports 104, a hot face 114, and a rotary plate face 15. The passageways 16 are essentially the same as that disclosed and described above. In the block 100 shown in FIG. 6, as seen from the top view in FIG. 7, the passageways 16 are all parallel and circularly oriented around the central axis of the injection block 100. This also shows in the bottom view of FIG. 8.

Figure 9:
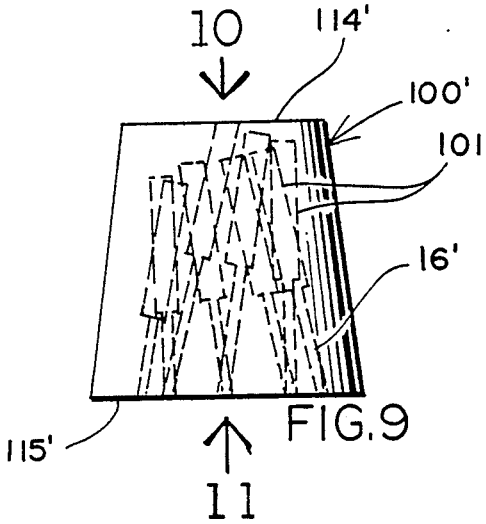
FIG. 9 is a front elevation of an injection block in which the passageways have been angled tangentially with the periphery of the injection block.
Figure 10:
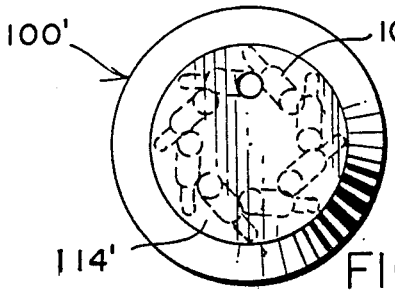
FIG. 10 is a top view of the injection block shown in FIG. 9.
Figure 11:
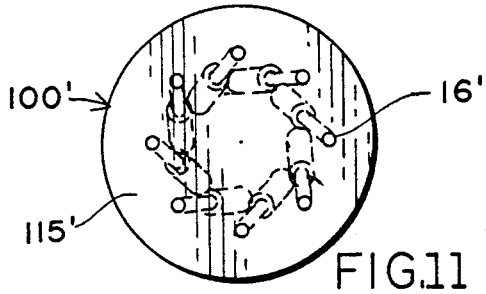
FIG. 11 is a bottom view of the injection block shown in FIG. 9.

In FIG. 9, and as exemplified more specifically in FIGS. 10 and 11 being respectively top and bottom views, the injection block 100′ has its passageways 16′ angled tangentially with regard to the frustoconical periphery of the block 100′.

Figure 12:
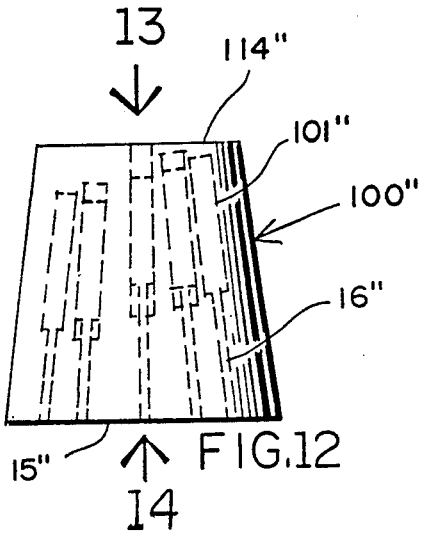
FIG. 12 is a front elevation of yet another injection block in which the passageways are angled substantially parallel with the exterior walls, and at an angle with the vertical axis of the injection block.
Figure 13:
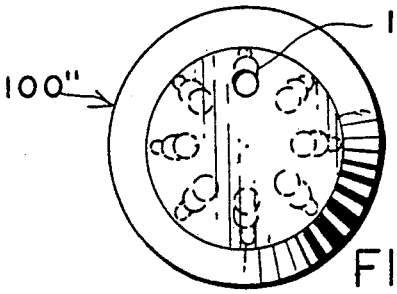
FIG. 13 is a top view of the injection block shown in FIG. 12.
Figure 14:
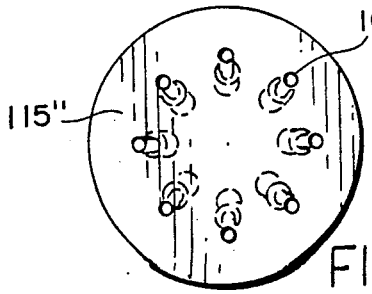
FIG. 14 is a bottom view of the injection block shown in FIG. 12.

In FIG. 12, and as exemplified in FIGS. 13 and 14 the injection block 100″ has the passages 16″ angled substantially parallel to the frustoconical periphery of the block 100″, and circumferentially oriented around the central axis.

Figure 15:
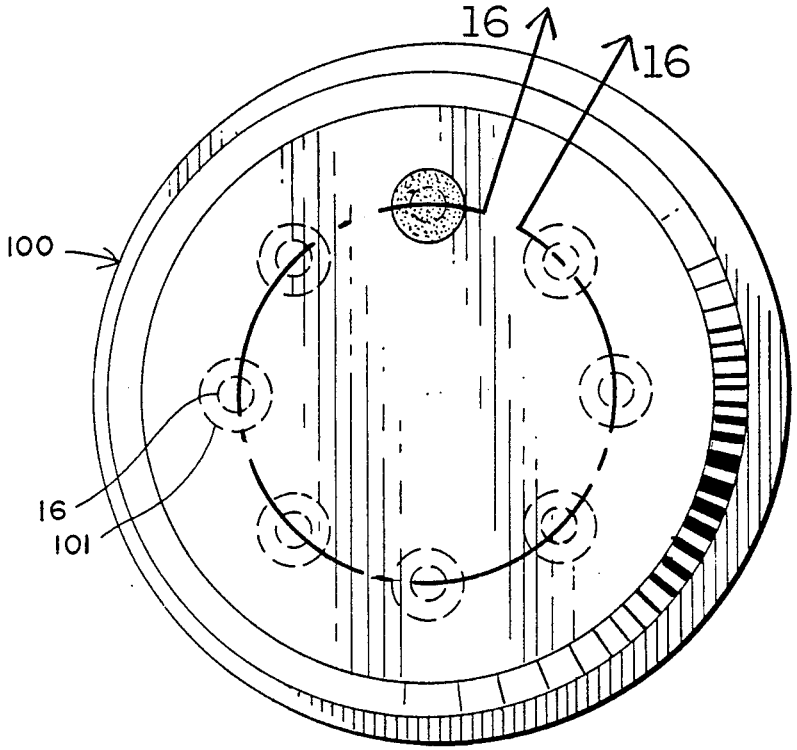
FIG. 15 is a top view of an illustrative injection valve such as shown in FIG. 6 illustrating the fold-out plan for the permeable plugs.

Turning now to FIG. 15 it will be seen that the progressive embedding of the permeable blocks 101 in the refractory block 100 is in regular stepped configuration in accordance with the sequential opening of the injection passageway by rotating the injection slide plate 20.

In review, there is shown a multiple element permeable refractory system that is valved for the ultimate in prevention of metal penetration through the porous elements and thereby out through the wall of the vessel. The permeable elements are staged by their initial positions relative to the hot or wet face of the injection block 100, with each successive permeable element 101 in sequence being located further from the starting plane of the hot or wet face of the injection block 100. This allows successive permeable elements 101 to be exposed for use as the hot face of the element block is eroded away in service by the molten metal.

Due to the permeability of the high porosity plugs, and the agitation of the metal against the exposed end of the porous elements, the porous element erodes faster than the surrounding refractory. With a porous plug the life is determined by the erosion of the plug. The plug must be changed when it is eroded to the end of its useful life. It is not safe to put multiple plugs in the ladle and use them successively due to the erosion of the plugs that are not in service and the possibility of penetration through the used plug or plugs. When the valve is sequenced, however, as disclosed in the present invention, because all elements except the one in use are shut off by the injection slide plate, break-out is inhibited. Premature erosion, that is, erosion before use of the permeable elements is prevented because they are not exposed at all. The spacing of the permeable elements relates to the hot face and is determined empirically by the comparative erosion rate of the hot or wet face of the block material and the erosion rate of the permeable elements in service.

Figure 5:
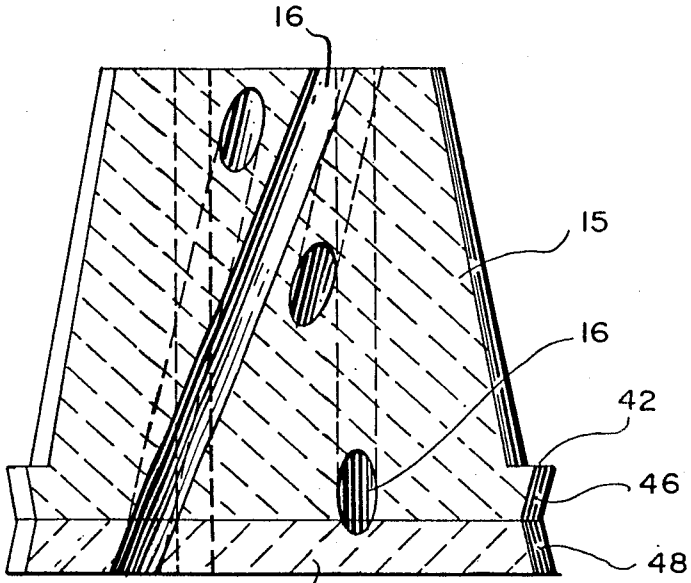
FIG. 5 is a sectional view taken along section line 5—5 of FIG. 4 and illustrating the path of a single injection orifice passage and the orientation of other injection orifice passages.
Figure 16:
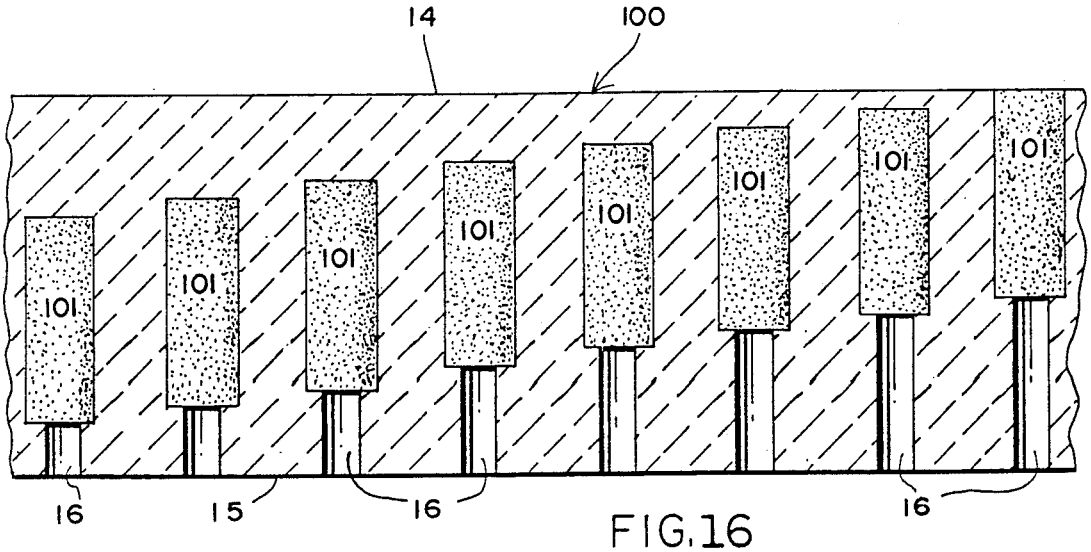
FIG. 16 is the fold out taken along section line 16—16 of FIG. 15.

The method of the present invention is directed to the injection of fluid by orienting the permeable plugs progressively deeper from the refractory block hot face. The method looks also to the orientation of the injection passages at a radial angle to the axis of the injection device and/or at a tangential angle to an element parallel to the axis of the injection device to provide a circumvolving flow about the axis of the injection device in order to assure the maximum diversion from the vertical axis of the ladle or containing vessel regardless of the mounting position of the injection device. Therefore, the angularity is achieved as shown in FIG. 2 where it is radial toward the axis of the injection device in a frustoconical orientation of the various orifices. A second version is shown in FIGS. 3, 4 and 5 where the angularity is not only achieved radially toward the axis of the injection device but also tangentially so as to circumvolve the axis of the injection device. It is also contemplated that lesser and greater angularity can be utilized. The progressive erosion sequencing of the hot face to expose the permeable plugs is best shown in FIG. 16.

Although particular embodiments of the invention have been shown and described in full here, there is no intention to thereby limit the invention to the details of such embodiments. On the contrary, the invention is to cover all modifications, alternatives, embodiments, usages and equivalents as fall within the spirit and scope of the present invention, specification, and appended claims.

What is claimed is:

1. A refractory injection block for use with an injection valve, said block comprising a refractory member having opposed end portions, said block having means at ne end portion for engaging a sliding injection plate and an injection mechanism, said block having a plurality of orifices and corresponding passages passing from the sliding injection plate into the block, the improvement comprising a plurality of permeable members, at least one in each passage, staggered in sequential increasing depth in said passages with the upper portion of the passages closed in staggered sequential increasing depth by the refractory block.

2. In the injection block of claim above, said orifice passage being angled radially toward the axis of the injection block.

3. In the injection block of claim 2 above, said orifice passage being angled radially toward the axis of the injection block at least 5°.

4. In the injection block of claim 3 above, said orifice passages being angled tangentially relative to an element parallel to the axis of said block so that the axis of the passage circumvolves the axis of said block.

5. In the injection block of claim 4 above, said orifice passages being angled tangentially relative to an element parallel to the axis of said block more than 15° but less than 180° so that the axis of the passage circumvolves the axis of said block.

6. In the injection block of claim 5 above, said orifice passages being angled radially toward the axis of said block and also angled tangentially relative to an element parallel to the axis of said block so that the axis of said passage circumvolves the axis of said block.

7. An injection block for use with an injection valve, said block being made of a refractory material and having two opposed outer portions and an axis, said block having means at one outer portion for engaging a sliding injection plate and an injection mechanism, said block having a plurality of orifices and corresponding orifice passages leading to these orifices which passages connect orifices on the opposed outer portions, a permeable plug in each said orifice passages, sequential ones of said permeable plugs being capped by the refractory block material at progressively greater depth to enhance sequential exposure due to the erosion of the outer portion opposite engaging means on the other outer portion.

8. In the injection block of claim 7 above, said orifice passages being angled radially toward the axis of the injection block.

9. In the injection block of claim 8 above, said orifice passages being angled radially away form the axis of the injection block.

10. In the injection block of claim 9 above, said orifice passages being angled radially relative to the axis of the injection block at least 5°.

11. In the injection block of claim 10 above, said orifice passages being angled tangentially relative to an element parallel to the axis of said block so that the axis of the passage circumvolves the axis of said block.

12. In the injection block of claim 11 above, said orifice passages being angled tangentially relative to an element parallel to the axis of said block more than 15° but less than 180° so that the axis of the passage circumvolves the axis of said block.

13. In the injection block of claim 12 above, said orifice passages being angled radially relative to the axis of said block and also angled tangentially relative to an element parallel to the axis of said block so that the axis of said passage circumvolves the axis of said block.

14. A method of metallurgy in a vessel comprising the steps of, positioning an injection valve on the bottom or sidewall of the vessel, positioning an injection block in said valve, forming separate paths for injection of fluid interiorly of such injection block to angle the injection as it enters the vessel radially toward the axis of the injection block, and positioning a permeable plug at sequentially increasing depths within the injection block paths, and injecting fluid interiorly of the injection block through the paths for injection of fluid interiorly of such injection block.

15. A method of metallurgy in a vessel comprising the steps of, mounting an injection valve to the bottom or sidewall of the vessel, positioning an injection block in the valve, directing paths for injection of fluid interiorly of such injection block to angle the injection as it enters the vessel radially away from the axis of the injection block, and positioning a permeable plug at sequentially increasing depths within the injection block paths for injection, and injecting a fluid interiorly, of the injection block through the paths for injection of fluid interiorly of such injection block.

16. A method of metallurgy in a vessel comprising the steps of, positioning an injection valve on the bottom or sidewall of a vessel, inserting an injection block in said valve, positioning paths for injection of fluid interiorly of such injection block to angle the injection as it enters the vessel so that it circumvolves the axis of the injection block, and positioning a permeable plug at sequentially increasing depth within the injection block paths and injecting a fluid interiorly of the injecting block through the paths for injection of fluid interiorly of such injection block.

17. A method of metallurgy in a vessel comprising the steps of, positioning and injection valve on the bottom or sidewall of a vessel, locating an injection block in said valve, forming paths for injection of fluid interiorly of such injection block to angle the injection as it enters the vessel both radially relative to the axis of injection block and tangentially so it that circumvolves the axis of the injection block, and positioning a permeable plug at sequentially increasing depths within the injection block paths and injecting a fluid interiorly of the injection block through the paths for injection of fluid interiorly of such injection block.

* * * * *